US005350233A

United States Patent [19]

Sonntag et al.

[11] Patent Number: 5,350,233

[45] Date of Patent: Sep. 27, 1994

[54] MIXING APPARATUS AND METHOD FOR FORMING A BLENDED COMPOSITE MATERIAL FROM A PLURALITY OF COMPONENTS

[75] Inventors: Donald W. Sonntag, Titusville; Brian Skeuse, Middlesex, both of N.J.

[73] Assignee: Reagent Chemical & Research, Inc., Middlesex, N.J.

[21] Appl. No.: 949,394

[22] Filed: Sep. 22, 1992

[51] Int. Cl.[5] ..... B01F 15/04; B01F 5/06

[52] U.S. Cl. ..... 366/160; 366/339

[58] Field of Search ..... 366/160, 161, 162, 152, 366/19, 16, 17, 176, 336, 337, 338, 339; 221/134, 145, 137, 288

[56] References Cited

U.S. PATENT DOCUMENTS

| | | | |
|---|---|---|---|
| 2,847,196 | 8/1958 | Franklin | 366/148 |
| 3,623,704 | 11/1971 | Skobel | 366/160 |
| 4,881,820 | 11/1989 | Luckhoff | 366/152 |

*Primary Examiner*—Robert W. Jenkins
*Attorney, Agent, or Firm*—Timothy J. Martin

[57] ABSTRACT

A mixing apparatus dispenses a composite material blended from metered components, at least one of which may be a viscous material. The apparatus includes a blending assembly for blending the components into the composite material and for thereafter dispensing the composite material out of a dispensing nozzle. The apparatus also has metering assemblies which are in communication with a respective component and which are each switchable between a measuring mode and a discharge mode. A control system concurrently places the metering assemblies in the discharge mode, and an ejection assembly concurrently ejects the selected quantities of the components into the blending assembly and thereafter out of the dispensing nozzle. The blending assembly is disclosed to be a static or a dynamic, and, where a static system is used, a plurality of static elements are disposed in a serpentive flowpath. The metering assemblies may include metering cylinders that are mechanically linked or otherwise controlled to measure and dispense the components, and structure is provided to allow variation in the ratios and quantities of the components.

25 Claims, 9 Drawing Sheets

MIXING APPARATUS AND METHOD FOR FORMING A BLENDED COMPOSITE MATERIAL FROM A PLURALITY OF COMPONENTS

TECHNOLOGICAL FIELD

The present invention generally relates to the blending of component materials, especially viscous materials into a resultant composite product. More specifically, however, the present invention concerns on-line manufacturing apparatus and processing methodology for cyclically dispensing a volume of a composite viscous product, preferably for packaging, which composite product is blended while being dispensed.

BACKGROUND OF THE INVENTION

The field of dispensing technology has become increasingly important as a result of the incorporation of automatic packaging equipment into modern production facilities. As noted in my earlier patent, U.S. Pat. No. 4,974,755, issued Dec. 4, 1990, particular problems confront the automated dispensing of viscous materials since, due to their relative high surface tension, the materials cling together onto the dispensing equipment to which they are associated. In my patent, I disclose a dispensing valve assembly and system which is relatively simple and durable yet which is highly accurate in dispensing viscous materials. This improved dispensing valve assembly and system incorporated a "snuff-back" feature directed at the elimination of unwanted spillage, drippage and the like.

Viscous materials, as noted in my patent, are flowable but are difficult to handle; examples of these viscous materials which are subject for automated dispensing equipment were given. In the food industry, such materials as butter, peanut butter, jellies, cheeses and the like fit into this category. In the cosmetic industry, viscous materials include such compositions as thick lotions, gels, creams, etc. In the chemical industry, viscous materials are found both in the household chemical industry and the industrial chemical industry. Household chemicals include such diverse products as shoe polish, greases, hand cleaners, etc.; industrial chemicals include greases and other petroleum products, sealants and adhesives, to name a few.

My earlier patent discussed accurate dispensing of these viscous materials, but yet another problem confronts the packaging industry where a manufacturer desires to dispense a composite viscous product that has been blended from a plurality of components. By way of example, in viscous food products a manufacturer may often want to add a flavoring material, a preservative or a coloring agent to a base viscous material in process. In the cosmetics industry, different coloring agents and fragrances may be added to a common base carrier material to produce cosmetics of different hues and shades and products having different olfactory sensations. Likewise, in the chemical industry, coloring agents and other additives may often be incorporated into a composite viscous product. One such example is in the manufacture of caulking compounds wherein a base compound material may be tinted with different colors so that different decorative appearances may be obtained by the user.

Where low viscosity materials are concerned, mixing of a plurality components together so that they are intimately blended often does not present significant problems. On the other hand, viscous materials resist blending by their very nature; hence, either the intimate blending of a plurality of viscous materials together or an additive component to a base viscous material presents a substantial challenge.

Heretofore, manufacturers have found it necessary to blend multi-component viscous systems in large mixing vats thereby requiring a substantial quantity of the material to be prepared as a "minimum run". Where a manufacturer desires to produce a family of products all having a common base material to which is added a different modifying component, such as a coloring agent, it is often necessary for the manufacturer to preblend in excessive quantity of each material. This procedure is quite inefficient and generates excessive inventory on one hand and substantial waste on the other.

The reason for these drawbacks is that a manufacturer, after mixing the minimum quantity of the particular member of the family of products, must package the entire quantity of mixed material or otherwise store the blended material for later use. The need to change production and dispensing among the family members necessitates the purging of the dispensing equipment each time a change is made so that substantial waste often results. Further, the need to purge the mixing and dispensing equipment is time consuming and thus expensive to the manufacturer. It is not unusual to use hazardous cleaning compounds to clean mixing equipment and to otherwise purge the dispensing equipment for the various family members when a switch from one family member to another is made. This of course is costly and environmentally unattractive due to hazardous waste disposal problems.

Accordingly, there has been a long felt need for mixing apparatus especially constructed for viscous materials wherein a composite material may be blended from a plurality of components without the need for preblending the components prior to their introduction into dispensing apparatus. There has thus been a need for mixing and dispensing apparatus that allows a manufacturer to use a common base material which is altered at the last possible point in the dispensing operation so that only minimal purging and cleaning is required when varying the blended composite material from one type to another. At the same time, there is the need that the blending of plural components is successfully accomplished so that the plural components are intimately mixed with one another.

SUMMARY OF THE INVENTION

It is an object of the present invention to provide a new and useful apparatus and method for blending a composite material from at least two components, one of which is a viscous material.

Another object of the present invention is to provide an apparatus and method wherein the intimate blending of a composite material from a plurality of components is accomplished immediately before dispensing so as to minimize the amount of blended material present in the dispensing equipment and reservoirs associated therewith.

Yet another object of the present invention is to provide a mixing and dispensing apparatus and methodology which eliminates the need to pre-mix a large quantity of blended material prior to its introduction into the dispensing equipment.

Still a further object of the present invention is to provide a mixing and blending apparatus and method wherein a viscous base material is blended with a second component immediately prior to being dispensed, for example, into a packaging container.

Another object of this present invention is to provide an apparatus and methodology which eliminates the costs, both economic and environmental, attendant to the cleaning and purging of mixing and dispensing equipment by reducing the amount of unwanted blended material present in the system when a changeover is desired between members of a product family.

A still further object of the present invention is to provide apparatus and methodology that allows the blending of components, at adjustable ratios, into a final viscous product immediately prior to being dispensed.

According to the present invention, then, an apparatus and method is described for mixing and dispensing a selected quantity of composite material which is blended from a first component measured from a first source of material and a second component measured from a second source of material. In its broad form, the apparatus according to the present invention includes a blending assembly which is in fluid communication with a first metering assembly and a second metering assembly. The first metering assembly operates to measure a selected quantity of a first component and is switchable between a first measuring mode and a first discharge mode. Likewise, the second metering assembly operates to measure a selected quantity of a second component and is switchable between a second measuring mode and a second discharge mode. When the metering assemblies are in the measuring mode, they are respectively in fluid communication with the first and second sources of material so that the desired quantity of each is measured. When the measuring assemblies are in the discharge mode, the metering assemblies are in fluid communication with the blending assembly which, in turn, is provided with a dispensing nozzle. The metering assemblies include ejection means which concurrently eject the measured quantities of the first and second components into the blending assembly and thereafter dispense the resulting blended composite material from the dispensing nozzle. A control device is provided to switch the first and second metering assemblies between the first and second measuring and discharge modes.

The first and second metering assemblies may each include a valve assembly and a metering cylinder associated therewith. The ejection means can then be piston members slideably mounted in each of the metering cylinders and, if desired, the pistons may be mechanically linked to one another so that they reciprocate as a common unit. These pistons may be driven by piston rods connected to air or hydraulic actuated cylinders connected to a source of compressed air or a fluid through control valves that are operated by the control device which may be a microprocessor. Likewise, the valve assemblies of each of the first and second metering assemblies may be operated by air or hydraulic actuated cylinders also connected through control valves to the compressed air or a fluid source with the control valves again being operated by the control device.

According to one exemplary embodiment of the present invention, the measured amounts of the first and second components are introduced first into a mixing chamber which is in fluid communication with the dispensing nozzle. The mixing chamber may be formed as an elongated flowpath into which is inserted one or more static mixing elements. Here, the flowpath may be serpentine, with several parallel portions, and several blending element sections may be placed in respective ones of the flowpath portions. In any event, the blending element has left-hand and right-hand spiral vanes, in equal number, to minimize total torque thereon as the material advances along the flowpath. Alternatively, the blending element may be a dynamic blending element that is driven by a suitable motor.

In order to allow variance in the ratios of the first and second components, the second metering cylinder may be provided with different displacement sets of piston elements having different volumetric displacements which may be universally mounted on the metering cylinder housing. Thus, the quantity of the second component may be varied simply by interchanging the displacement sets including a slideable rod which defines the piston and the associated rod seals and bushings. Alternatively, separate mechanical drives may be used for each metering cylinder so that the displacement stroke of the metering pistons can be varied.

The present invention also discloses a method of mixing a blended composite material from two components which method may be accomplished by the described apparatus. In this broad form, the method includes the steps of providing a first source of the first component material and second source of a second component of material. A selected quantity of the first component and a selected quantity of the second component is then measured. Next, the first and second selected quantities are simultaneously introduced into and flowed through an elongated flowpath and, while in the flowpath, are thoroughly blended to form the blended composite. Finally, the blended composite product is dispensed through a dispensing nozzle. The steps of measuring the first and second selected quantities may occur simultaneously or as separate steps, and the blending of the intermediate product may be accomplished by either a static or a dynamic mixing nozzle.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENT

The present invention concerns the mixing and dispensing of materials, and in particular, the present invention is directed to the blending of multi-component viscous materials into a final composite material. In the exemplary forms of the present invention, apparatus and methodology are described for blending a composite product from a two component system. The exemplary embodiments of the present invention are described, by way of example, in use for the blending of a viscous base material, such as a caulking compound, with a coloring agent. It should be understood, that the possible applications of the apparatus and methodology according to the present invention may be employed with other composite products in the chemical, food and cosmetic industries, to name a few.

Viscous materials, as a class, present difficult problems in manufacturing and packaging apparatus and procedures. Where multi-component systems are used to produce a composite product, it is found that relatively high viscosity materials do not readily blend with one another. Accordingly, the production steps of blending and packaging are typically independent operations. That is, a manufacturer often blends a bulk quantity of composite material which is then supplied to dispensing equipment so that a selected quantity of the composite material may be dispensed into packaging containers. An improvement to the controlled dispensing of such viscous materials, whether as single components or as a pre-blended composite product, was disclosed in my U.S. Pat. No. 4,974,755.

While the manufacturing and dispensing technology described above has valuable applications, in many instances these procedures have disadvantages. Since it is necessary to pre-blend a fairly large minimum quantity of material from the components, all of the material must be dispensed and inventoried. The present invention, however, makes it possible to mix and dispense viscous materials in a single processing step and eliminate the need to pre-blend the product. It is thus particularly useful where a base material provides a first component that is to be mixed with a second component, such as a coloring agent.

Figure 1:
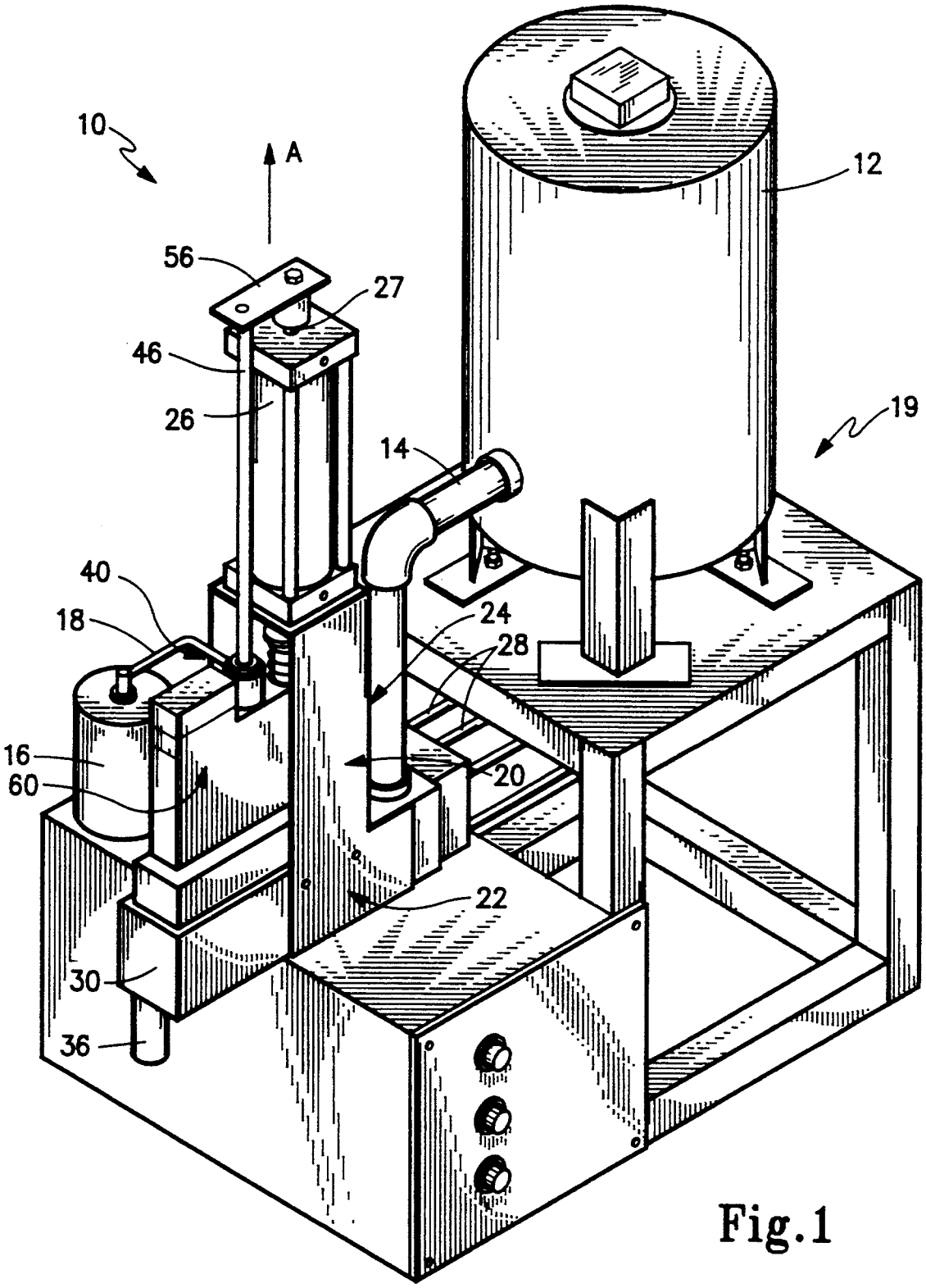
FIG. 1 is a perspective view of a mixing and dispensing apparatus according to a first exemplary embodiment of the present invention.
Figure 7:
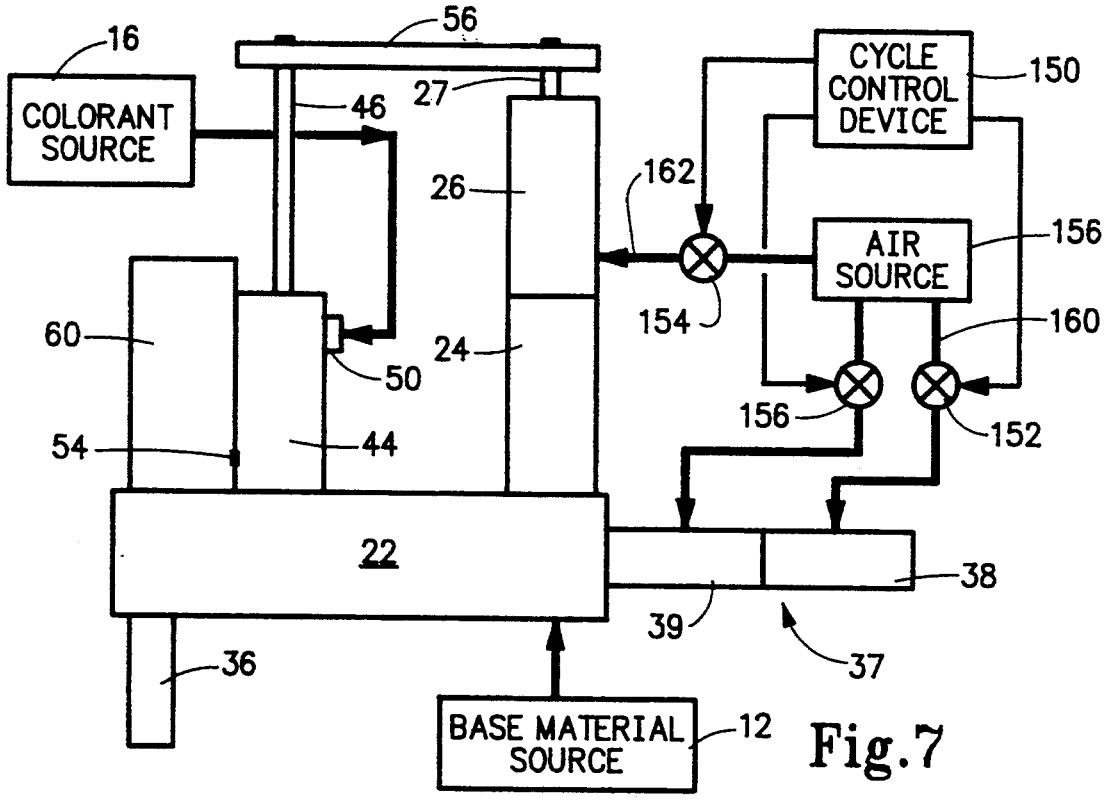
FIG. 7 is a diagrammatic view showing the mixing and dispensing apparatus according to the present invention for use in coloring a base material.

As is shown in FIGS. 1 and 7, then, mixing and dispensing apparatus 10 according to a first exemplary embodiment of the present invention is shown in conjunction with a source 12 of a first component, such as a base material and a source 16 of a second component, such as a coloring agent. Source 12 is in fluid communication with mixing and dispensing apparatus 10 through a conduit 14, and second source 16 of material may be connected in fluid communication to mixing and dispensing apparatus 10 by means of a conduit 18. The flow of material from conduit 14 is controlled a first valve and metering assembly 20, and the flow of material from conduit 18 is controlled by a second metering assembly 40 and its associated check valves, as described more thoroughly below. Blending assembly 60 is also shown in FIGS. 1 and 7, and blending assembly 60 operates to receive and thoroughly blend selected quantities of the first and second components, as measured respectively by metering assemblies 20 and 40.

Figure 2A:
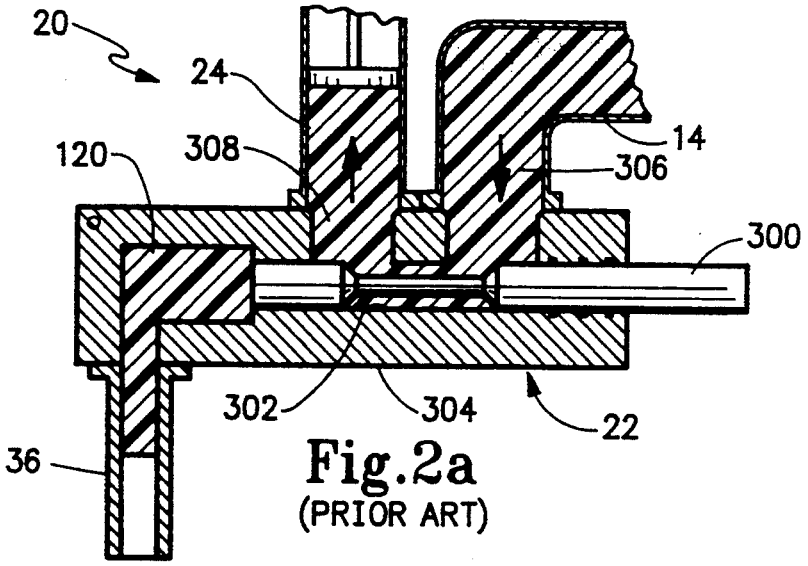
Fig.2a (PRIOR ART)
FIGS. 2(*a*)–2(*c*) are cross-sectional views of a first metering valve assembly according to my earlier U.S. Pat. No. 4,974,755 which is used in the exemplary embodiments of the present invention.
Figure 2B:
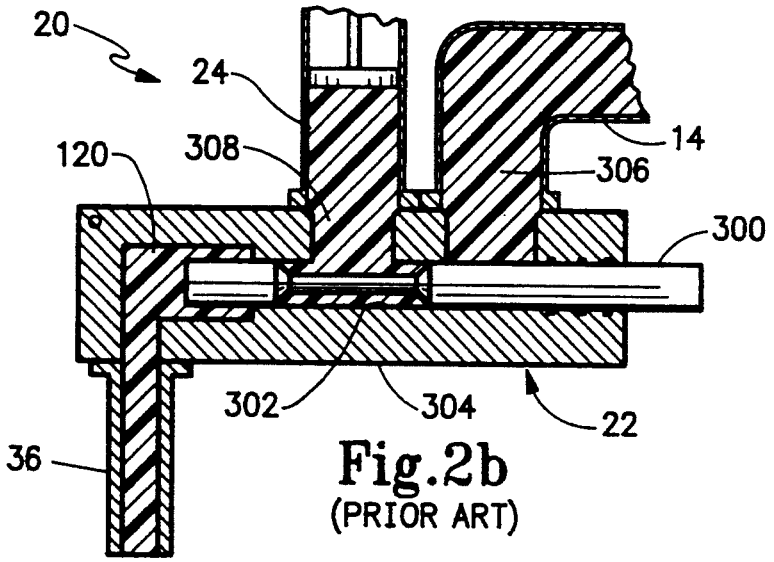
Fig.2b (PRIOR ART)
Figure 2C:
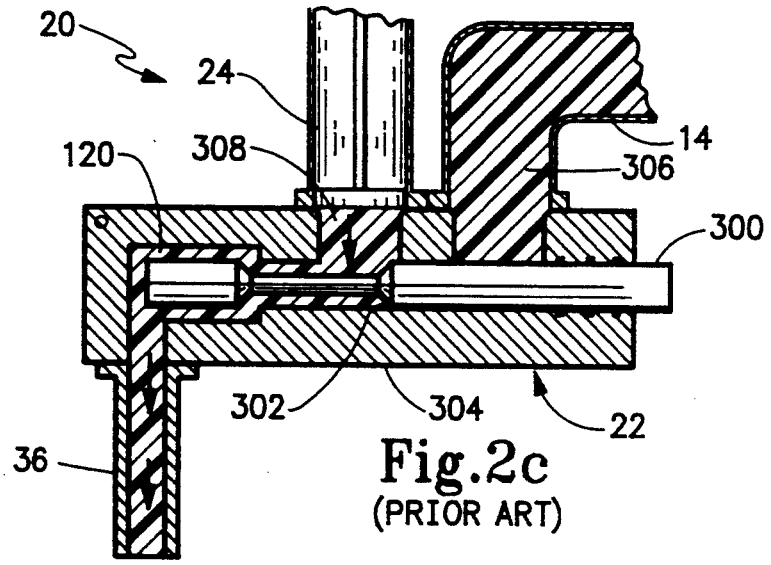
Fig.2c (PRIOR ART)

First valve and metering assembly 20 includes a first metering cylinder 24 connected to valve assembly 22, which, as far as the valve structure thereof, is the same as that described in my U.S. Pat. No. 4,974,755 the disclosure of which is incorporated herein by reference and which is shown in FIGS. 2(*a*)–2(*c*). It should be understood, however, that valve assembly 22 could take other forms within the scope of the prior art. First metering cylinder 24 is controlled by an air or hydraulically actuated cylinder 26, as is known in the art so that material from source 12 may be dispensed through a dispensing section 30 having a nozzle 36. Cylinder 26 includes a drive shaft 27 which may be advanced upwardly in the direction of arrow "A" in FIG. 1 and returned in a reciprocal manner. As shown in FIG. 1, first material source 12, second material source 16 first metering assembly 20 and second metering assembly 40 may be supported by means of a common frame 19. It should be understood, however, that material sources 12 and 16 could be remotely located and that other support frame structure could be employed.

First valve and metering assembly 20 is shown in FIGS. 2(*a*)–2(*c*), and it should be understood that these Figures disclose that valve assembly structure described in detail in my U.S. Pat. No. 4,974,755. Here, a valve element 300 is shown to be reciprocally received in a valve passageway 302 a valve body or casing 304 of valve assembly 22. A downstream end of the valve passageway 302 opens into an internal mixing chamber 120. An inlet port 306 and a metering portion 308 extend radially outwardly from valve passageway 302 and respectively communicate with conduit 14 and first metering cylinder 24. Valve element 300 reciprocates between the start cycle position shown in FIG. 2(*a*), through intermediate position shown in FIG. 2(*b*) and to a discharge position shown in FIG. 2(*c*); valve element then returns through the intermediate position shown in FIG. 2(*b*) back to the start cycle position of FIG. 2(*a*). Suitable seals are provided as described in U.S. Pat. No. 4,974,755.

Figure 3:
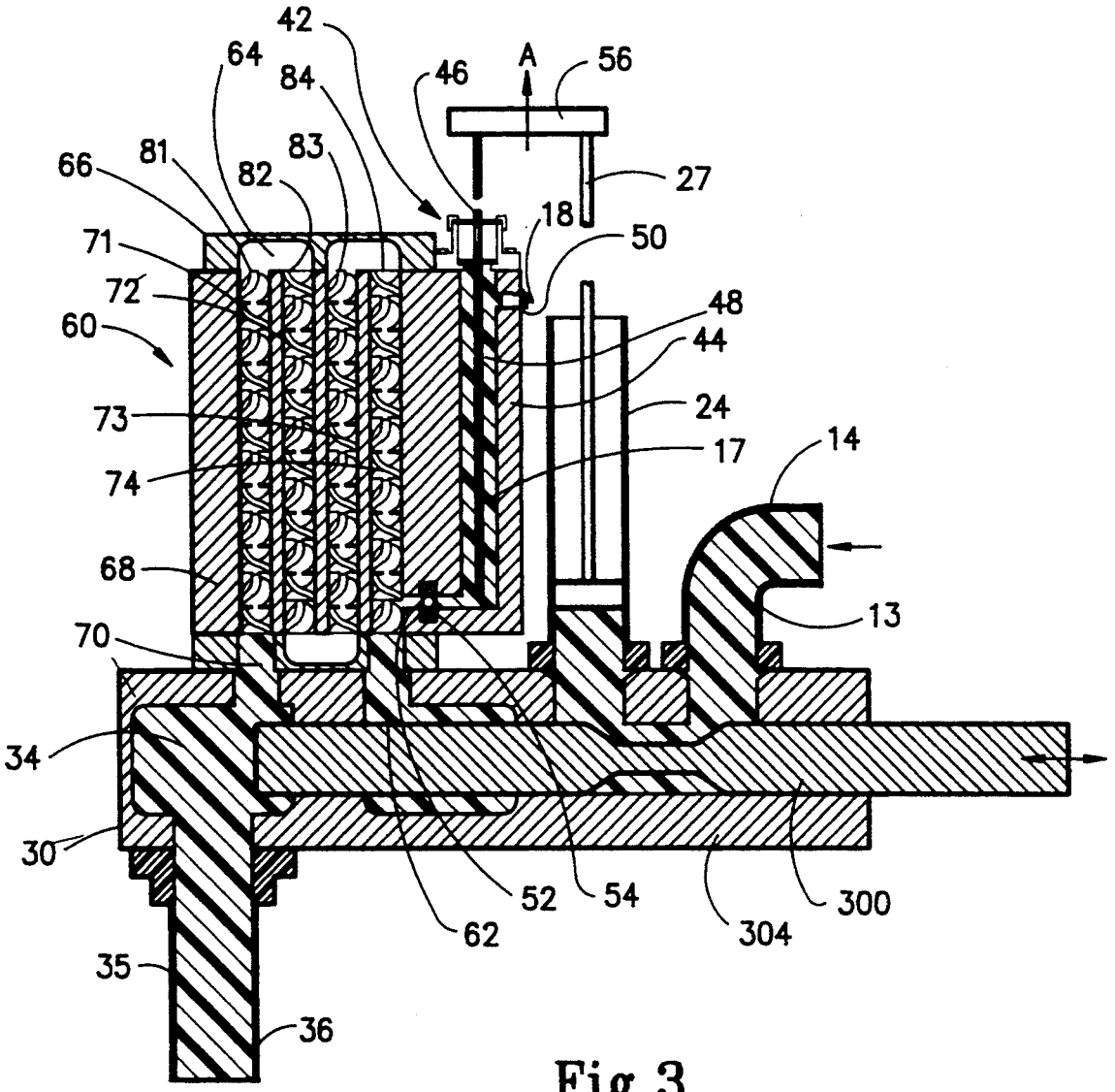
FIG. 3 is a side view in cross-section showing the metering cylinders, the valve assemblies and the blending assembly of the mixing and dispensing apparatus of FIG. 1 shown at the beginning of the measuring mode.
Figure 4:
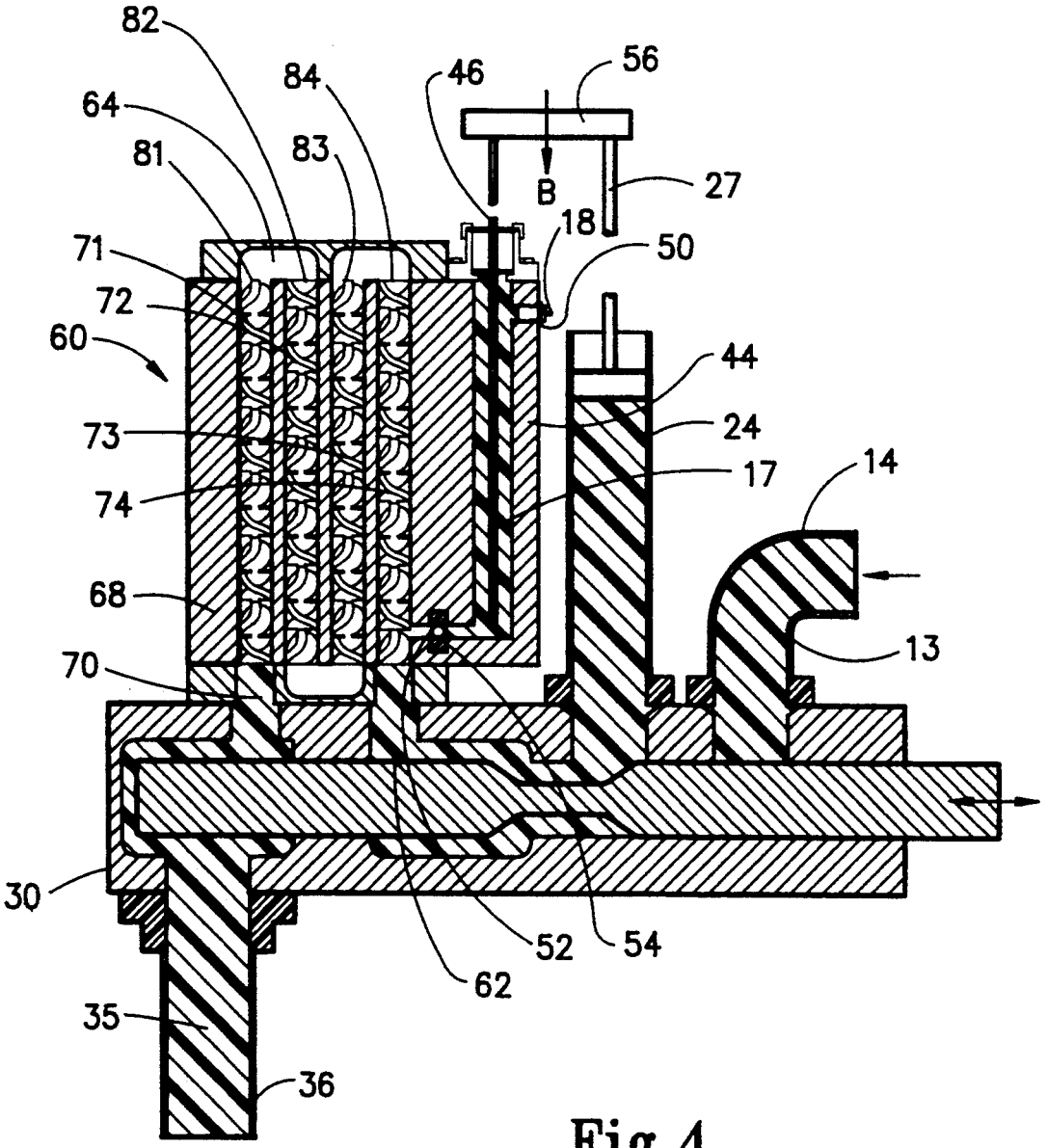
FIG. 4 is a side view in cross-section, similar to FIG. 3, but shown at the beginning of the discharge mode.

Second valve and metering assembly 40 along with blending assembly 60 is best shown in FIGS. 3 and 4, and the interaction of these two assemblies with first valve and metering assembly 20 may be more thoroughly understood and appreciated with reference to these two Figures. Second valve and metering assembly 40, as shown in these Figures, includes a metering cylinder 44 which is closed at one end by a displacement rod and end seal structure 42 through which a metering rod 46 extends into the interior 48 of metering cylinder 44. Interior 48 is preferably a cylindrical cavity that is in fluid communication with the second source 16 by way of conduit 18 and a first check valve 50 which allows for one-way flow of material into interior 48. Metering cylinder 44 has an outlet port 52 which is in fluid communication with interior 48 through a second one-way check valve 54 which allows for the one-way flow of material out of metering cylinder 44.

Metering rod 46 is physically interconnected to drive shaft 27 by means of link 56. Thus, drive rod 27 and metering rod 46 are linked for common reciprocal movement when drive rod 27 is actuated by cylinder 26. Accordingly, as shown in FIG. 3, when drive rod 27 and metering rod 46 move in the direction of arrow "A" at the start of measuring mode, metering cylinder 24 is in a first measuring mode wherein first material 13 begins to fill metering cylinder 24. Likewise, second metering cylinder 44 is placed in a second measuring mode wherein second material 17 begins to fill interior 48 of metering cylinder 44 through check valve 50. At the end of the first and second measuring modes, as shown in FIG. 4, check valve 50 automatically closes and valve element 300 is driven shifts to the left thereby closing metering cylinder 24 from communication with conduit 14. Drive rod 27 and metering rod 46 begin to move in the direction of arrow "B" which dispenses the metered materials 13,17 into blending assembly 60. At the end of the cycle, valve element 300 is shifted to the right, as shown in FIG. 3, which "snuff backs" the blended composite material 35 in nozzle 36, all as described with respect to my U.S. Pat. No. 4,974,755.

Again with reference to FIGS. 3 and 4, it should be appreciated that blending assembly 60 is a static apparatus having no moving parts. The first and second metered quantities of first component 13 and second component 17 are introduced into blending assembly 60 at entry port 62. Blending assembly 60 defines a mixing chamber 64 that is in the form of an elongated, serpentine flowpath, and a static blending element is disposed in this elongated flowpath. For example, as is shown in FIGS. 3 and 4, the elongated flowpath preferably includes four parallel flowpath portions 71, 72, 73 and 74 which each receive a blending element section 81, 82, 83 and 84, respectively. Blending element sections 81–84 are held in position by a removable end cap 66 which mounts onto main body 68 of blending assembly 60 by means of bolts, screws or the like. The blending element defined by blending element sections 81–84 acts to thoroughly intermix and blend intimately the measured components from metering cylinders 24 and 44 so that the blended material may be discharged at outlet 70 located at the downstream end of serpentine flowpath so that the material, may pass through chamber 34 and then through dispensing nozzle 36. It should thus be appreciated that metering cylinders 24 and 44 not only act to measure the selected quantities of the first and second components, but further provide an ejection means for concurrently ejecting the first and second selected quantities and ultimately dispensing the composite material from nozzle 36.

Figure 5:
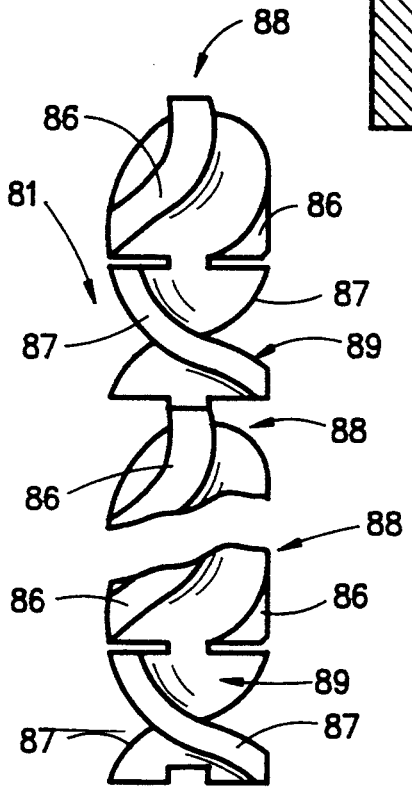
FIG. 5 is a side view in elevation showing a static blending element used in the blending assembly shown in FIGS. 3 and 4.

The structure of a representative blending element section 81 is shown in FIG. 5 where it should be appreciated that each of blending element sections 81–84 is formed of a plurality of right-hand vanes, such as vanes 86 and a plurality of left-hand vanes, such as vanes 87 which are organized into left-hand stations 88 and right-hand stations 89 with each of vanes 86,87 being spiral in configuration. Thus, blending element sections 81–84 are formed as cylindrical screw-like pieces, except that each of blending element sections 81–84 has an equal number of right-hand stations 88 and left-hand stations 89 so that, as the material flows past a respective blending element, the net torque on the blending element is minimized since consecutive left and right-hand station attempt to rotate the respective blending element in opposite directions.

Figure 6A:
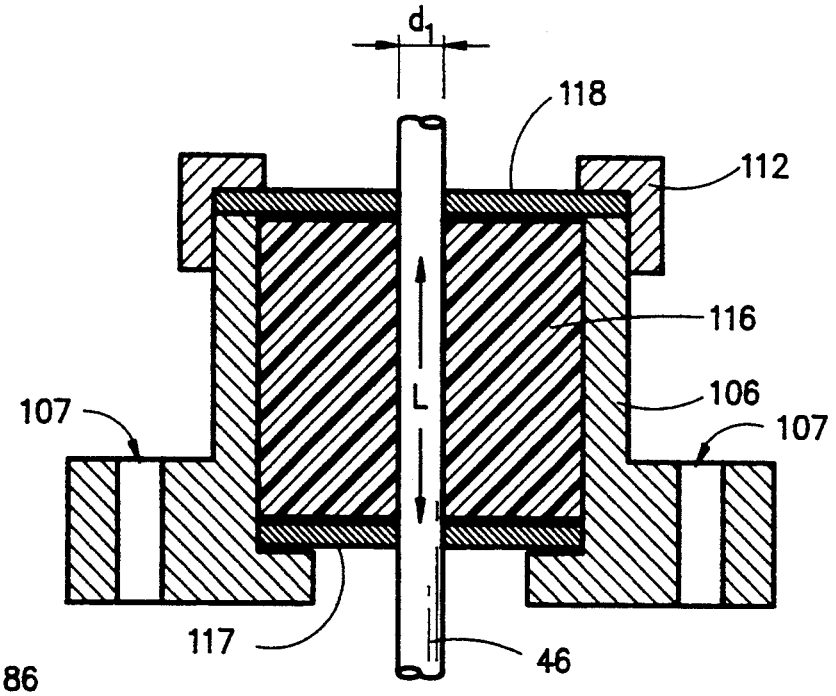
FIGS. 6(*a*) and 6(*b*) are side views in partial cross-section of a distal portion of the second metering cylinder of FIGS. 3 and 4 showing two different displacement sets each having differently sized metering rods.
Figure 6B:
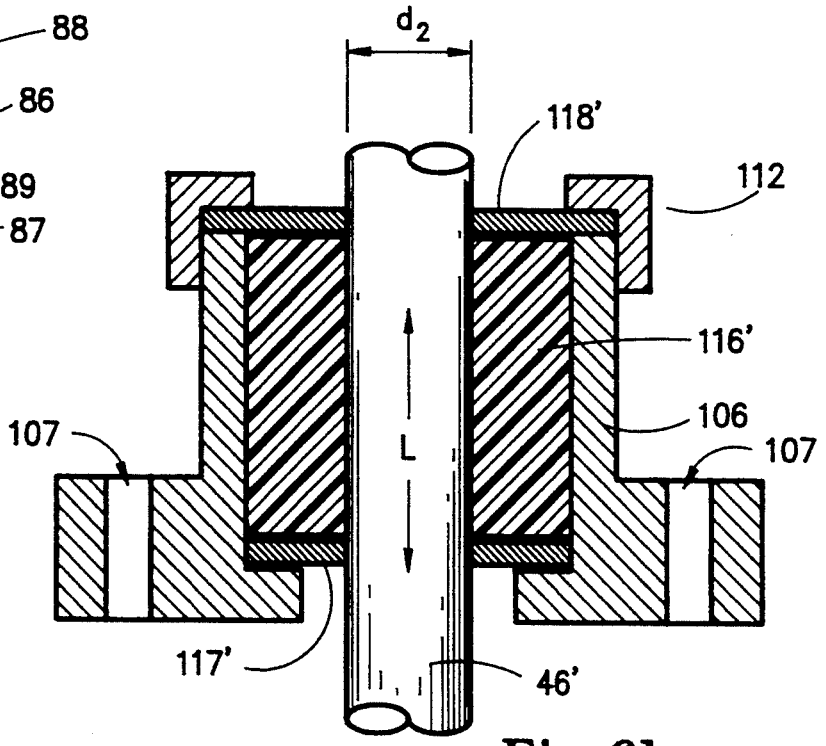

The structure described above with reference to FIGS. 4 and 5 has an advantage in that the amount of the second component may be varied in a relatively simple manner. To this end, where the distance of travel of the displacement rod remains constant, variance in the diameter (and thus the cross-section) of the displacement rod varies the volume of the second component displaced by the rod. Hence, the amount of material ejected from second metering cylinder 44 is controlled by the length of travel of the displacement rod and by the displacement rod's diameter. With reference to FIGS. 6(*a*) and 6(*b*), it may be appreciated that two examples of differently sized cylindrical displacement rods 46 and 46′ are shown for use with a common rod seal housing 106 and a common threaded cap 112 that is threadably received on rod seal housing 106. By exchanging rod 46 and 46′, the volume of the second component that is blended with the first component may be adjusted. However, when a selected displacement rod 46 or 46′ is used, it is necessary to use appropriately sized bushings seals and bushing retainers. Thus, a matched bushing seals and corresponding bushing retainers define a displacement set that may be used to vary the ratio of components to be blended into the blended composite material.

In FIG. 6(*a*), it may be seen that displacement rod 46 is slideably mounted by bushing seal 116 which is held in position with respect to rod seal housing 106 by means of bushing retainers 117 and 118 and a threaded seal cap 112. Rod 114 has the length of travel "L" and a diameter "$d_1$". Thus, where $V_1$ equals the volume of material to be displaced, $V_1=(\pi L)(d_1)^2/4$. As noted above, this volume may be varied by changing the diameter of displacement rod 46, an example of which is shown in FIG. 6(*b*). Here, displacement rod 46′ has a diameter "$d_2$" and is slideably received in bushing seal 116′ which has an internal opening size to receive the diameter of rod 46′. Bushing 116′ is retained in position in rod seal housing 106 by means of bushing retainers 117′ and 118′ and seal cap 112′. It may be noted that the outer diameters of bushing 116′ and bushing retainer ring 118′ are the same as the respective parts in FIG. 6(*a*) so that they may be mounted in standard end cap 106 and seal cap 112. End cap 106 is designed to be bolted onto second metering cylinder 44 through bolt holes 107.

Therefore, in order to vary the displacement volume $V_2$, it is only necessary to interchange a displacement set comprising the rod seal, the seal cap, the bushing, the bushing retainer ring and, of course, the displacement rod. Accordingly, for a given displacement "L", the volume displaced by displacement rod 46′, that is, $V_2$, is described by the equation: $V_2=(\pi L)(d_2)^2/4$.

Figure 8:
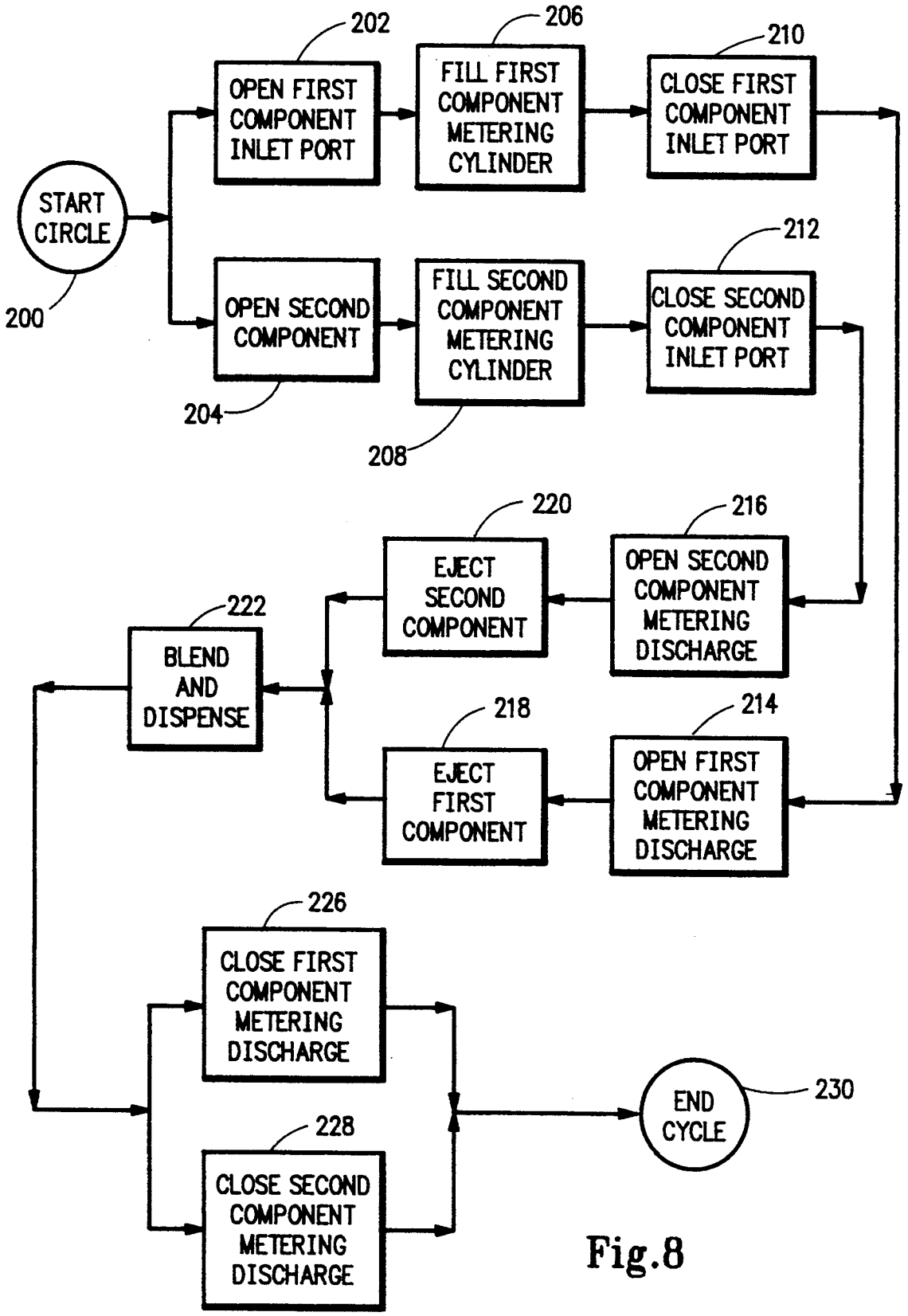
FIG. 8 is a flow chart showing the processing steps according to the preferred method of the present invention.

The operation of the mixing apparatus according to the present invention may now be more fully appreciated with reference to FIGS. 7 and 8. These Figures respectively show a diagrammatic view of the mixing apparatus and a flow chart of the operation of the drive cylinders and valving assemblies of the present invention. To this end, it should be appreciated that the mixing apparatus and metering assemblies may be controlled by a microprocessor unit or other cycle control device 150 which acts to open and close a plurality of valves 152, 154 and 156. Further, as described in FIG. 7, the drive cylinders are depicted as air actuated cylinders, but it should be understood that hydraulic cylinders, other actuators, or mechanical drives could be used instead.

At the start of a metering and dispensing cycle, at 200, valve element 300 (FIG. 2(*a*)) is open to the first component source 12 which is shown for explanatory purposes as a base material to which a colorant is to be added as the second component. Therefore, the colorant, from colorant source 16, has a positive pressure at check valve 50 so that second metering cylinder is opened to receive the colorant. This status is diagrammed at 202 and 204 in FIG. 8. Metering cylinders 24 and 44 are thus filled, as is shown at steps 206 and 208, and cycle control device 150 signals valve 152 to open. When valve 152 opens, compressed air from air source 156 is presented to a first section 38 of two-way air cylinder 37 by way of conduit 160. Activation of section 38 causes valve element 300 to close inlet portion 306 to isolate metering cylinder 24 from source 12, as is shown at step 210 and in FIG. 2(*b*) and to thereafter move valve element 300 through the intermediate position of FIG. 2(*b*) to the discharge position of FIG. 2(*c*). This continued movement opens the metering port 308 so that it is in communication with entry port 62 of blending assembly 60, as is diagrammed at step 214. This allows check valve 50 to close so that the filled metering cylinder 44 is isolated from source 16; check valve 54 may correspondingly open as diagrammed at steps 212 and 216. Cycle control device 150 then opens valve 154 to supply compressed air to cylinder 26 by way of conduit 162. Activation of cylinder 26 simultaneously drives rods 27 and 46 downwardly to dispense the metered base material and the metered colorant material simultaneously into blending assembly 60 as diagrammed at 218 and 220. The first and second components, such as the base material and colorant material are then thoroughly blended, at step 222, by static blending elements 81–84 and afterwards dispensed into a suitable container by way of nozzle 36. When the measured material and metering cylinders 24 and 44 have been dispensed, cycle control device 150 closes valves 152 and 154 and then opens valve 156 to supply compressed air to section 39 of two-way air cylinder 37. This causes valve element 300 to return through the intermediate position to close metering port 308. The closing of the metering cylinders from the discharge mode is diagrammed at steps 226 and 228, corresponding to "end cycle" 230, and the opening of the metering cylinders to the fill mode is at steps 202 and 204 corresponding to "start cycle" 200.

From the foregoing, it should now be appreciated that the present invention also includes a new and useful process for mixing two components into a blended composite material. However, it should be specifically understood that this mixing method could be used to mix more than two components in a multi-component system. However, for sake of explanation, the mixing method for a two-component system comprises a first step of providing a first source of a first component material and a second source of a second component material. A first selected quantity of the first component is then measured, for example by the first metering cylinder described above, and a second selected quantity of the second component material is measured again for example by the second metering cylinder, above. The first and second measured quantities may be measured simultaneously. After measurement, the first and second selected quantities are simultaneously introduced into and flowed through an elongated mixing flowpath, and thoroughly blended to produce the blended composite material as they are flowed through the mixing flowpath. Finally, the blended composite material is dispensed through a dispensing nozzle. Where a multi-component system is used, it should be understood that the measuring of each quantity of each component occurs concurrently and each of the selected quantities of the component materials are introduced into the mixing chamber substantially simultaneously. The step of thoroughly blending the first and second components into the composite material in the mixing flowpath may be accomplished by providing either static or dynamic blending elements.

An alternative exemplary embodiment of the present invention is shown in FIGS. 9–12, and this alternative embodiment includes a different valving structure for switching the second metering cylinder 44 between the second measuring mode and the second discharge mode. Also, this alternative embodiment employs a dynamic blending assembly in substitution for the static blending assembly of the previously described embodiment.

Figure 12:
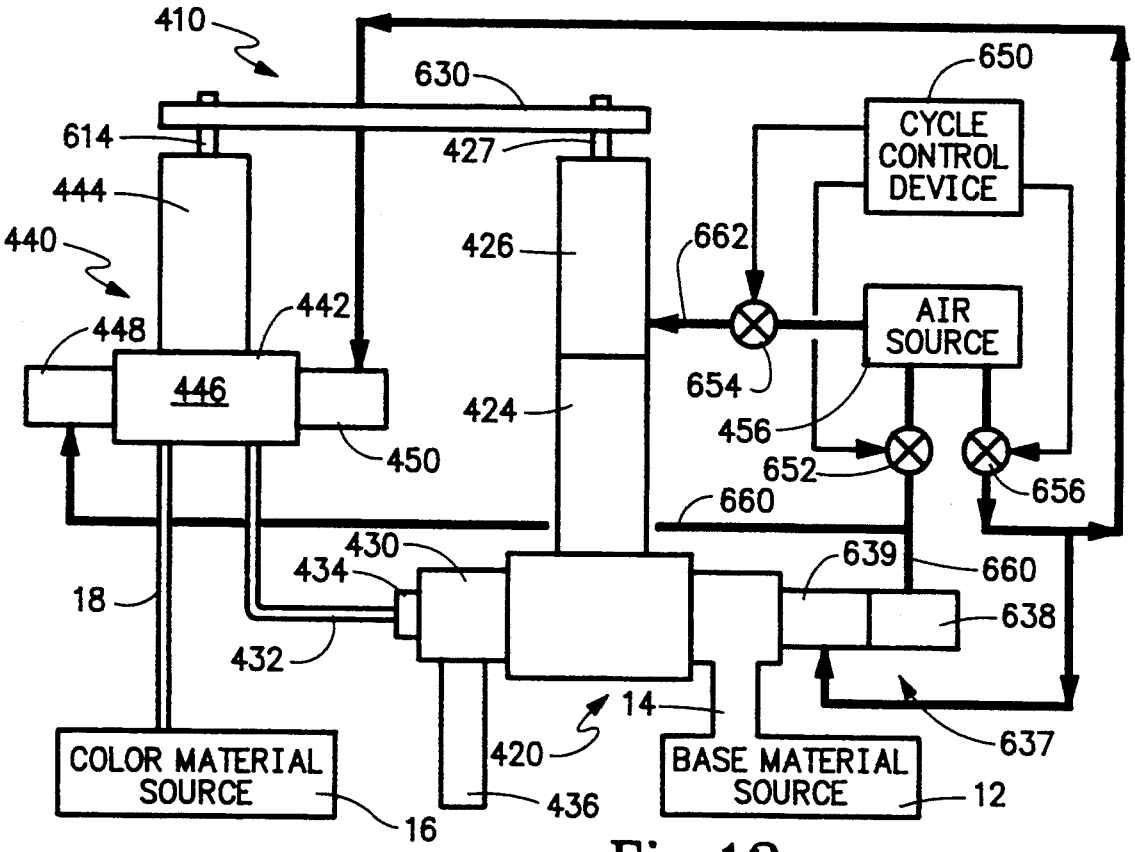
FIG. 12 is a diagrammatic view showing the mixing and blending apparatus according to the alternative embodiment of the present invention as used in coloring a base material.
Figure 9:
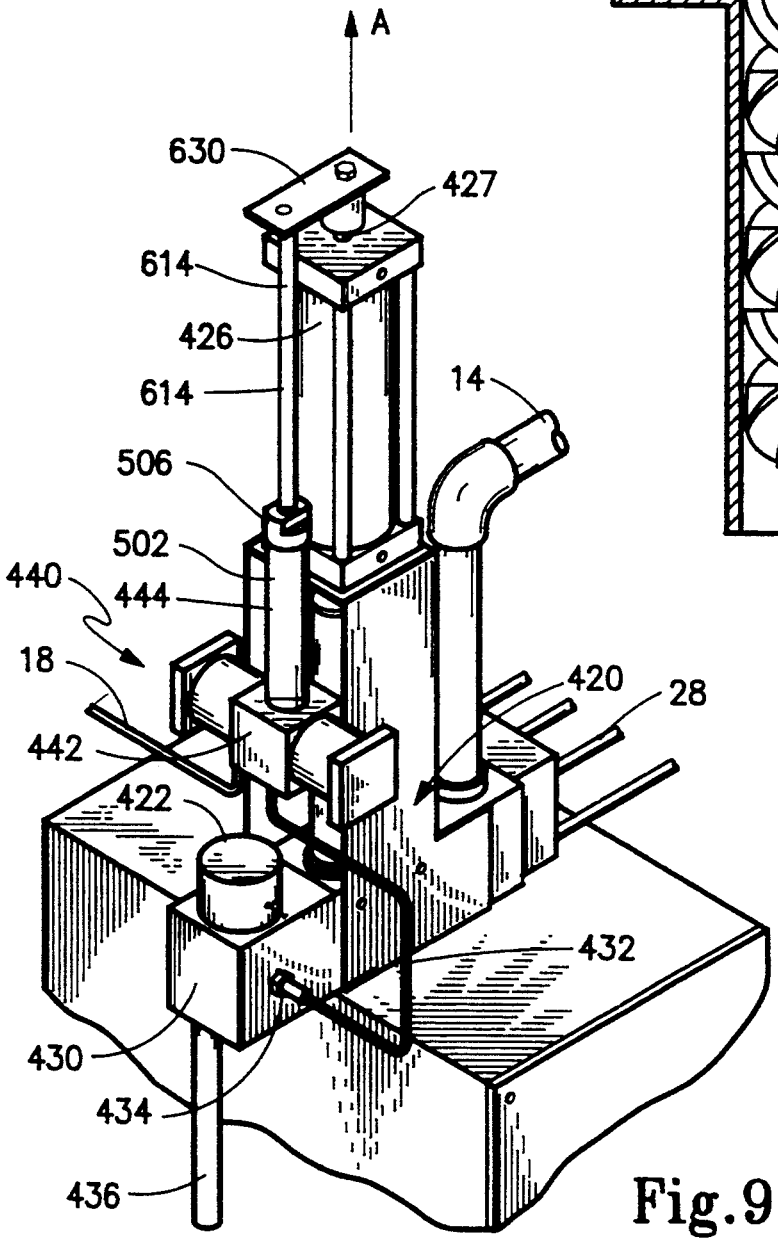
FIG. 9 is a perspective view of an alternative exemplary embodiment of the present invention showing an alternative second valve assembly and a dynamic blender.

Accordingly, as is shown in FIG. 9 and 12, mixing and dispensing apparatus 410 is shown for use with the first and second sources of component materials which are provided through conduits 14 and 18, respectively. The flow of the first material from conduit 14 is controlled by first valve and metering assembly 420, and the flow of the second material from conduit 18 is controlled by second valve and metering assembly 440. First valve and metering assembly 420 is substantially identical to the valve and metering assembly 20 described with respect to the first embodiment of the present invention and so that description is not again repeated here. However, it should be pointed out that the metered first component is discharged directly into an internal mixing chamber 520 instead of being discharged into inlet port 62 of static blending assembly 60, with this internal mixing chamber 520 being the same as chamber 120 in FIGS. 2(*a*)–2(*c*).

Figure 10:
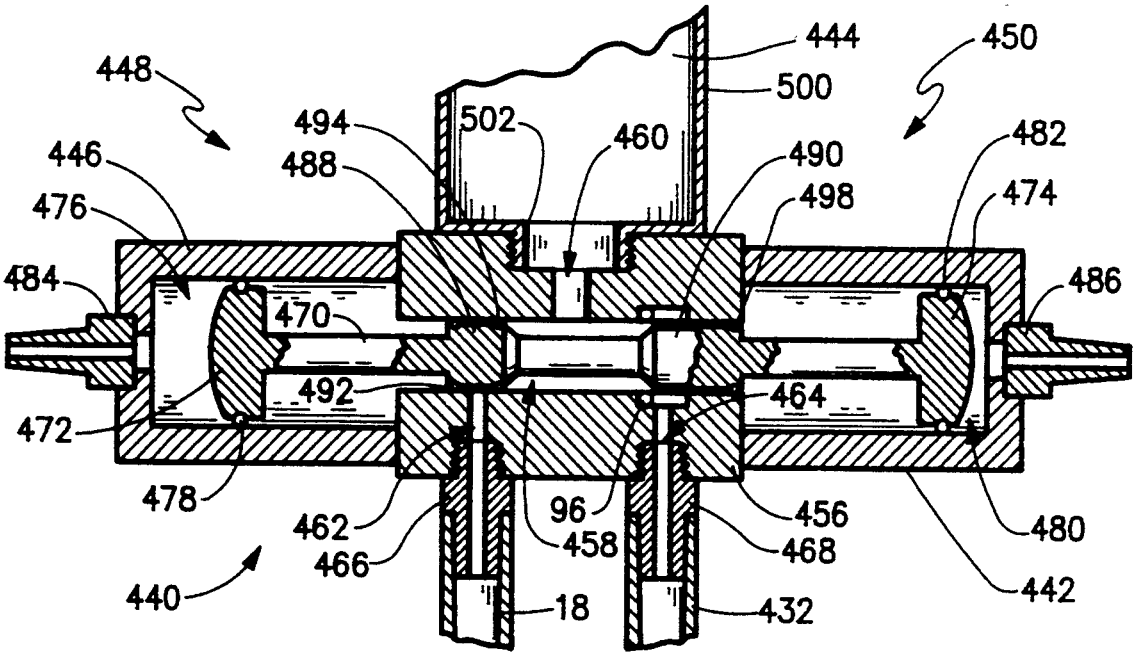
FIG. 10 is a side view in cross-section showing a portion of the second valve assembly of FIG. 9.

Second valve and metering assembly 440 is shown in greater detail in FIGS. 9 and 10. In these Figures, it may be seen that second valve and metering assembly 440 includes a second dispensing valve assembly 442 and a second metering cylinder 444. Valve assembly 442 includes a main body 446 which has a longitudinal passageway 458 extending therethrough. Radial port 460 extends through central body 456 so that it is in fluid communication between metering cylinder 444 and passageway 458. Similarly, a pair of radial ports, in the form of inlet port 462 and outlet port 464 extend through the sidewall of central body 456 with these ports being respectively in fluid communication with conduits 18 and 432 by means of threaded nipples 466 and 468. A valve shaft 470 extends longitudinally in passageway 458 and terminates at its outer ends in piston heads 472 and 474. Piston head 472 is received in the interior 476 of an air cylinder 448, for reciprocal motion therein, with piston head 472 being sealed against the sidewalls of cylinder 448 by means of O-ring seal 478. Similarly, piston head 474 is received in the interior 480 of an air cylinder 450 and is sealed against the sidewalls thereof by means of O-ring seal 482. Nipple connectors 484 and 486 are provided to respectively connect air lines 660 and 663 in fluid communication with the interiors 476 and 480, respectively, of air cylinders 448 and 450 which are connected to a source 456 of compressed air (FIG. 12).

The structure of the second dispensing valve 442 is in the form of a three-way valve, as is known in the art, and is typically known as a "double diaphragm three-way valve". To this end, it may be see that a central portion of valve shaft 470 is configured to have valve structures 488 and 490 respectively associated with inlet and outlet ports 462 and 464. Suitable O-ring seals 492, 494, 496 and 498 act to seal valve structures 488 and 490 during reciprocal motion. In operation, when air is supplied through nipple 484 into interior 476, valve shaft 470 moves to the right, as shown in FIG. 10, so that outlet port 464 is in fluid communication with metering cylinder 444. On the other hand, when air is supplied to the interior 480 of air cylinder 450, valve shaft 470 would be moved to the left. Valve structure 490 would then close the pathway from metering cylinder 444 to outlet port 464 and a flowpath from inlet 462 to metering-cylinder 444 would be opened by valve structure 488. Thus, as valve shaft 474 reciprocates through a cycle, valve structure 488 first opens a flowpath from inlet port 462 to metering cylinder 444 thus allowing a supply of the second component to be measured by metering cylinder 444. During this time, valve structure 490 prevents the second component from being discharged through outlet port 464. When valve shaft 470 advances to the right, as shown in FIG. 10, the supply of the second component through inlet 466 is blocked by valve structure 488 and the metered quantity of the second component, present in metering cylinder 444, may then be discharged through outlet port 464.

Figure 11:
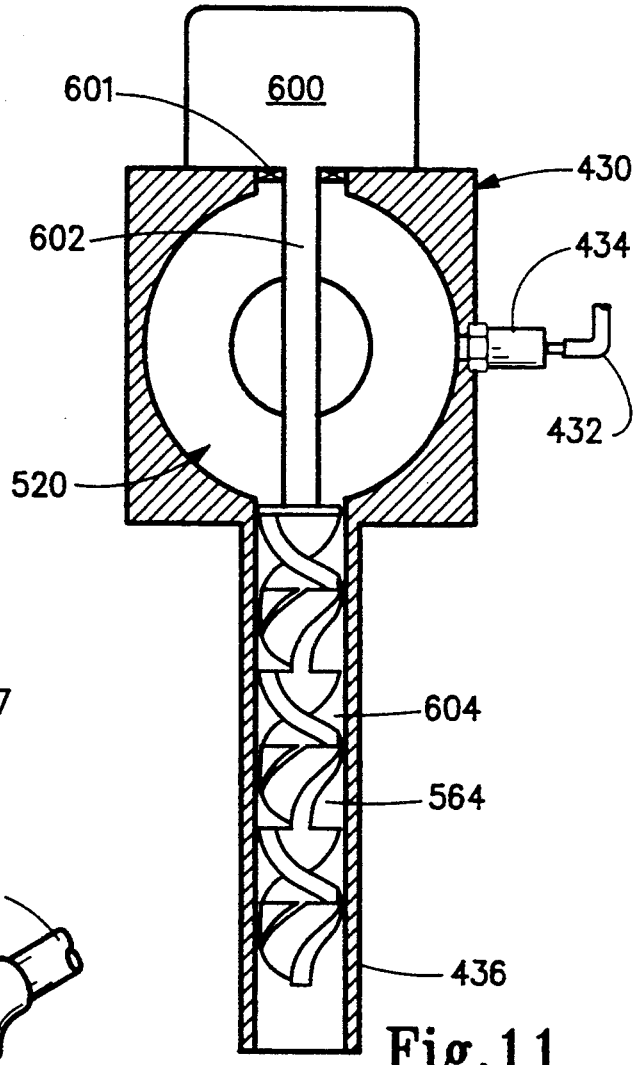
FIG. 11 is a view in partial cross-sectional showing the alternative embodiment of the mixing nozzle according to the exemplary embodiment of the present invention using a dynamic blender.

Metering cylinder 444 again includes a hollow cylindrical housing such as housing 500 which has a first end 502 that is threadably received in central body 446 of second dispensing valve 442. A second end 504 of housing 500 opposite end 502 is threadably capped by means of an end seal structure 506 which is of the same general structure as end seal structure 42 described with respect to the first exemplary embodiment, above, and may likewise receive different displacement sets to vary the amount of measured second component. Second valve and metering assembly 440 is in fluid communication with dispensing section 430 of first valve and metering assembly 420 by means of a conduit 432 connected to dispensing section 430 through a check valve 434, as is best shown in FIG. 11. In this Figure, it may also best be seen that the first and second components of material may be thoroughly blended into the composite material by way of a dynamic blending assembly including a drive motor 600, bearing 601, a drive shaft 602 and a dynamic blending element 604 rigidly secured for rotation with drive shaft 602. Blending element 604 may be constructed similarly to static blending elements 81–84 and is positioned in elongated flowpath 564 which here is provided in dispensing nozzle 436. The need for the substantially longer serpentine flowpath 64 and the plurality of static blending elements 81–84 oriented therein is eliminated by this dynamic blending assembly since thorough blending of the components is accomplished by the churning action of the mechanically driven single dynamic blending element 604.

The operation of the mixing apparatus according to the second embodiment of the present invention may now be more fully appreciated with reference to FIG. 12. This Figure shows a diagrammatic view of the mixing apparatus and the operation of the drive cylinders and valving assemblies of the present invention. To this end, it should be appreciated that the mixing apparatus and metering assemblies may be controlled by a microprocessor unit or other cycle control device 650 which acts to open and close a plurality of valves 652, 654 and 656. Further, as described in FIG. 12, the drive cylinders are depicted as air actuated cylinders, but it should again be understood that hydraulic cylinders or other actuators could be used instead.

At the start of a metering and dispensing cycle, valve element 300 (FIG. 2(*a*)) and valve element 470 are open to their respective component sources which are shown for explanatory purposes as a base material to which a colorant is to be added as the second component. Metering cylinders 424 and 444 are thus filled, after which cycle control device 650 signals valve 652 to open. When valve 652 opens, compressed air from air source 456 is presented to a first section 638 of two-way air cylinder 637 by way of conduit 660. Activation of section 638 causes valve element 300 to close inlet portion 306 to isolate metering cylinder 424 from source 12, and the movement of valve element 300 through the intermediate position of FIG. 2(*b*) continues to the discharge position of FIG. 2(*c*). This continued movement opens the metering port 308 so that it is in communication with mixing chamber 520. Simultaneously, air cylinder 448 causes valve element 470 to shift to the right (as is viewed in FIG. 10) so that the filled metering cylinder 444 is isolated from source 16 and opened to conduit 432. Cycle control device 750 then opens valve 654 to supply compressed air to cylinder 426 by way of conduit 662. Activation of cylinder 426 simultaneously drives rods 427 and 614 downwardly, due to mechanical link 630, to dispense the metered base material and the metered colorant material simultaneously into mixing chamber 520 of dispensing section 430 and out of nozzle 436.

When the measured material and metering cylinders 424 and 444 have been dispensed, cycle control device 650 closes a valves 652 and 654 and then opens valve 656 to supply compressed air simultaneously to section 639 of two-way air cylinder 637 and to air cylinder 450 by way of conduit 663. This causes valve element 300 to return through the intermediate position to close metering port 308 while simultaneously valve element 470 moves to the left (as viewed in FIG. 10) to shut off communication of conduit 432 with metering cylinder 444 and open cylinder 444 for communication with supply conduit 18, and the cycle may then repeat. It should be appreciated from the description that the measuring of the first and second components should occur concurrently, although not necessarily simultaneously, but the ejection of the measured components should occur simultaneously.

Figure 13:
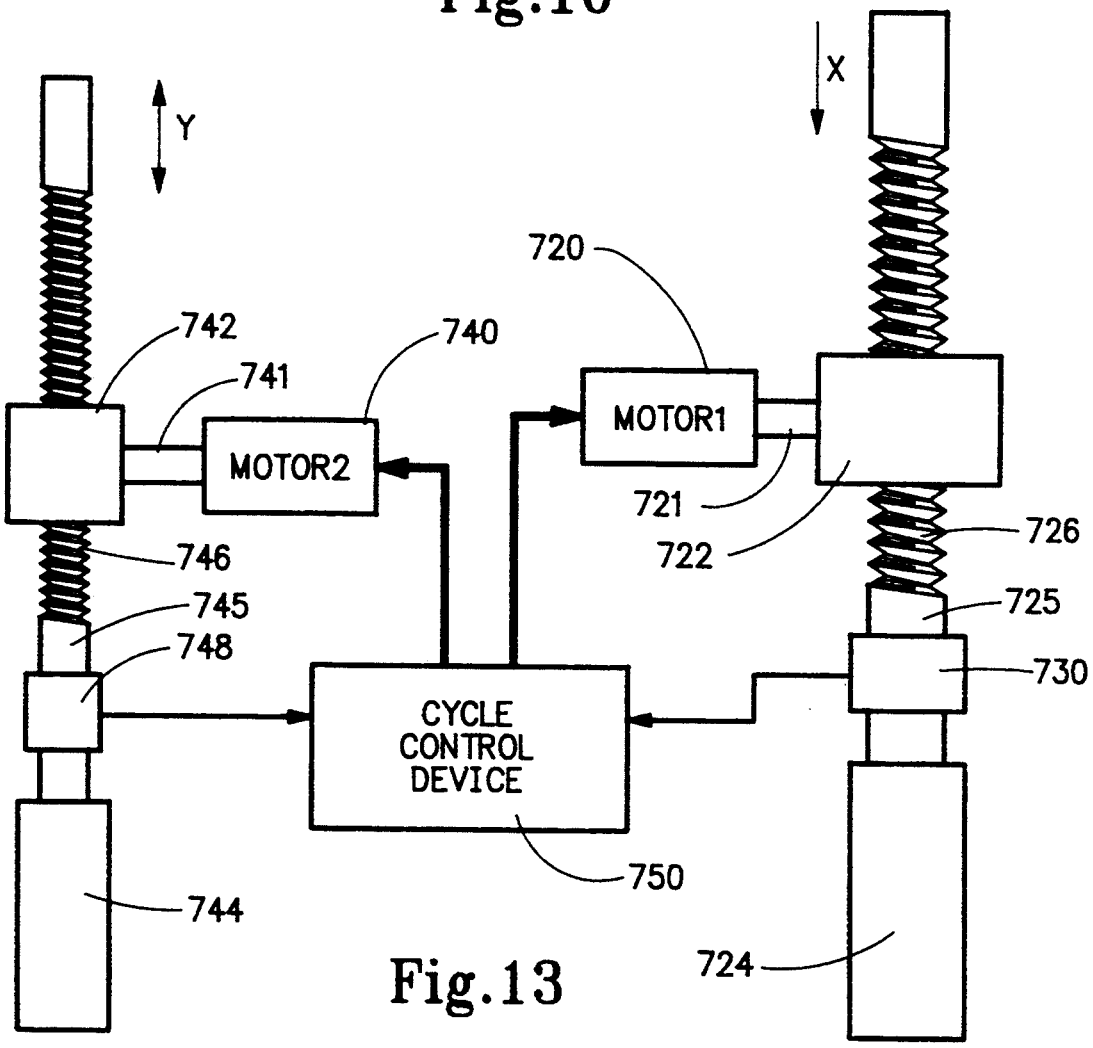
FIG. 13 is a diagrammatic view of a mechanical drive and ratio control system for use with either of the embodiments described in FIGS. 1–12.

With reference to FIG. 13, a diagrammatic view of a mechanical drive and ratio control system is shown. This system may be employed with either of the embodiments described in FIGS. 1–12 and allows for the option for controlling the dispensed composite material and the ratio of components forming that composite material without the need to interchange differently sized displacement rods for the metering cylinders. In FIG. 13, metering cylinder 724 is provided for the first component while metering cylinder 744 is shown for the second component. The amount of material dispensed from the respective cylinders is controlled by the linear displacement of cylindrical displacement rods 725 and 745, respectively. Displacement rod 725 is linear driven by a first motor 720 acting through a gear box 722 that is driven by output shaft 721 of motor 720. Displacement rod 725 is provided with threads 726, which may be of a wormgear type, so that rotation of shaft 724 may advance displacement rod 725 in the direction of arrow "X." To this end, motor 720 is reversible so that displacement rod 725 can be driven into and out of metering cylinder 724. The speed and position of displacement rod 725 is monitored by linear encoder 730 which provides input into cycle control device 750 which receives position and feedback speed from linear encoder 730.

Likewise, the amount of material to be dispensed from metering cylinder 744 is controlled by the linear displacement of linear displacement rod 745. Here again, suitable threading 746 is provided so that rod 745 may be driven in the direction of arrow "Y" by means of gear box 742 which is driveably connected to drive shaft 744 of a second motor 740. The speed and position of rod 745 is sensed by linear encoder 748 with this information then being fed into cycle control device 750. Control device 750 reversibly drives both of motors 720 and 740 according to the feedback information from encoders 730 and 748, and control device 750 can be preprogrammed to control the amount of displacement for each of displacement rods 725 and 745 so that the ratio of the two components may be adjusted. The speed of the advancement of each displacement rod may likewise be controlled so that the selected displacement of each occurs over the same interval of time thereby allowing for uniform injection of the components ultimately into the blending assembly, such as blending assembly 60 or the blending assembly shown in the second embodiment comprising drive motor 700, bearing 701, drive shaft 702 and dynamic blending element 704.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. Mixing apparatus adapted for dispensing a selected quantity of composite material blended from a first component measured from a first source and a second component measured from a second source, comprising:

(a) a blending assembly operative to intimately mix materials flowing therethrough, said blending assembly including a dispensing nozzle for dispensing said composite material and a blending element;

(b) first metering means for metering a first quantity of said first component at a selected first volume, said first metering means switchable between a first measuring mode wherein said first metering means is in fluid communication with the first source whereby the first quantity of said first component is measured and a first discharge mode wherein said first metering means is in fluid communication with said blending assembly whereby the first selected quantity may be introduced into said blending assembly;

(c) a second metering means for metering a second quantity of said second component at a selected second volume, said second metering means switchable between a second measuring mode wherein said second metering means is in fluid communication with said second source whereby the second selected quantity of said second component is measured and a second discharge mode wherein said second metering means is fluid communication with said blending assembly whereby the second selected quantity may be introduced into said blending assembly;

(d) control means for cyclically operating said first and second metering means to place said first metering means in said first measuring mode and said first discharge mode and said second metering means in said second measuring mode and said second discharge mode, said control means operative to concurrently place said first and second metering means in the respective said first and second discharge mode; and (e) ejection means for concurrently ejecting the first and second selected quantities out of said first and second metering means so that said first and second selected quantities are introduced into said blending assembly and thereafter dispensed through said dispensing nozzle as a composite material of a volume equal to the selected first and second volumes.

2. Mixing apparatus according to claim 1 wherein said first metering means includes a first metering cylinder and wherein said second metering means includes a second metering cylinder.

3. Mixing apparatus according to claim 2 wherein said ejection means includes a first piston slideably mounted in said first metering cylinder and operatively connected to a first piston rod extending outwardly therefrom, a second piston slideably mounted in said second metering cylinder and operatively connected to a second piston rod extending outwardly therefrom and drive means for advancing said first and second pistons whereby the respective first and second selected quantities are expelled from the respective first and second metering cylinder.

4. Mixing apparatus according to claim 3 wherein said first and second piston rods are mechanically linked to one another whereby movement of one of said first and second piston rods causes corresponding movement of the other of said first and second piston rods.

5. Mixing apparatus according to claim 4 wherein said drive means includes an air actuated cylinder.

6. Mixing apparatus according to claim 4 wherein said drive means includes a hydraulic cylinder.

7. Mixing apparatus according to claim 1 including means for varying the ratio of said first and second components.

8. Mixing apparatus according to claim 7 wherein said ejection means includes a first displacement piston, slideably mounted in said first metering cylinder and a second displacement piston slideably mounted in said second metering cylinder, and wherein said means for varying the ration of said first and second components includes means for varying distance of travel of at least on of said displacement pistons.

9. Mixing apparatus according to claim 1 including a mixing chamber disposed between said dispensing nozzle and each of said first and second metering means and in fluid communication therewith whereby said first and second components are concurrently introduced into said mixing chamber and then dispensed through said blending nozzle.

10. Mixing apparatus according to claim 9 wherein said mixing chamber defines an elongated flowpath, said blending element being disposed in said flowpath.

11. Mixing apparatus according to claim 10 wherein said blending element is a static element operative to thoroughly mix said first and second components flowing through said flowpath to form said composite material.

12. Mixing apparatus according to claim 11 wherein said blending element includes a plurality of spiral vanes formed as left-hand spiral vanes and right-hand spiral vanes, there being and equal number of left-hand and right-and spiral vanes whereby to minimize torque on said blending element resulting from the flow of said first and second components through said flowpath.

13. Mixing apparatus adapted for dispensing a selected quantity of composite material at a downstream location, said composite material formed by mixing a selected quantity of an upstream first component measured from a first source and a selected quantity of an upstream second component measured from a second source, comprising:

(a) a housing having an interior defining an elongated mixing chamber defining an elongated flowpath and having a dispensing nozzle located downstream of said chamber and in fluid communication therewith;

(b) a first metering cylinder in switchable fluid communication with said first component source and said mixing chamber;

(c) a second metering cylinder is switchable fluid communication with said second component source and said mixing chamber;

(d) control means for placing said first and second metering cylinders respectively in said first and second cylinder fill modes whereby said first metering cylinder is filled with a first selected quantity of said first component and said second metering cylinder is filled with a second selected quantity of said second component and for concurrently placing said first and second metering cylinders respectively is said first and second cylinder discharge modes;

(e) ejection means for concurrently ejecting the first and second selected quantities out of said first and second metering cylinders so that said first and second selected quantities are introduced concurrently into said mixing chamber and then dispensed through said dispensing nozzle;

(f) at least one dynamic, rotatable blending element disposed in the flowpath; and (g) drive means for rotating said blending element whereby said first and second components are thoroughly mixed to form said composite material.

14. Mixing apparatus according to claim 13 wherein said blending element is located within said dispensing nozzle. mixing chamber;

15. Mixing apparatus according to claim 13 wherein said ejection means includes a first discharge means associated with said first metering cylinder and a second discharge means associated with said second cylinder,-said first and second discharge means being linked to one another and wherein said ejection means includes a common drive means for operating said first and second discharge means.

16. Mixing apparatus according to claim 15 wherein said first and second discharge means are mechanically linked to one another.

17. A method of mixing a blended composite material from two components, comprising the steps of:

(a) providing a first source of a first component and a second source of a second component;

(b) measuring a first quantity of said first component at a selected first volume and a second quantity of said second component at a selected second volume;

(c) simultaneously introducing said first and second selected volumes into and flowing said first and second quantities through an elongated mixing flowpath having a blending element therein;

(d) thoroughly blending said first and second quantities to produce said blended composite material as said first and second quantities flow through said elongated mixing flowpath; and (e) dispensing said blended composite material through a dispensing nozzle.

18. The method according to claim 17 including the step of providing static blending element in said elongated mixing flowpath whereby said first and second quantities are statically blended into said blended composite material.

19. The method according to claim 17 including the step of providing a dynamic blending element in said elongated mixing flowpath whereby said first and second quantities are dynamically blended into said blended composite material.

20. The method according to claim 17 wherein the steps of measuring said first and second selected quantities is accomplished concurrently.

21. Mixing apparatus adapted for dispensing a selected quantity of composite material blended from a first component measured from a first source and a second component measured from a second source, comprising:

(a) a blending assembly operative to intimately mix materials flowing therethrough, said blending assembly including a dispensing nozzle for dispensing said composite material and a blending element;

(b) first metering cylinder operative to meter a first selected quantity of said first component, said first metering means switchable between a first measuring mode wherein said first metering means is in fluid communication with the first source whereby the first selected quantity of said first component is measured and a first discharge mode wherein said first metering means is in fluid communication with said blending assembly whereby the first selected quantity may be introduced into said blending assembly;

(c) a second metering cylinder operative to meter a second selected quantity of said second component, said second metering cylinder having an interior and a distal end and including a rod seal housing removably mounted on the distal end to enclose the interior, a displacement rod slidably received through a bore in said rod seal housing to defined ejecting means for said second metering cylinder, and rod seal means in said rod seal housing for maintaining a seal against said rod during reciprocal sliding motion of said rod into and out of the interior of said second metering cylinder, said second metering cylinder switchable between a second measuring mode wherein said second metering cylinder is in fluid communication with said second source whereby the second selected quantity of said second component is measured and a second discharge mode wherein said second metering cylinder is fluid communication with said blending assembly whereby the second selected quantity may be introduced into said blending assembly;

(d) control means for cyclically operating said first and second metering cylinders to place said first metering cylinder in said first measuring mode and said first discharge mode and said second metering cylinder in said second measuring mode and said second discharge mode, said control means operative to concurrently place said first and second metering cylinders in the respective said first and second discharge mode; and (e) ejection means for concurrently ejecting the first and second selected quantities out of said first and second metering cylinders so that said first and second selected quantities are introduced into said blending assembly and thereafter dispensed through said dispensing nozzle.

22. Mixing apparatus according to claim 21 including a plurality of displacement rods and rod seal means for said second metering cylinder to define displacement sets that may be interchanged with one another, the displacement rods respectively included in said displacement sets having different cross-sectional areas whereby different volumes in the interior of said second metering cylinder will be displaced thereby during reciprocal movement of the respective displacement rod into and out of the interior so that the amount of said second component introduced into said blending assembly may be varied.

23. Mixing apparatus adapted for dispensing a selected quantity of composite material blended from a first component measured from a first source and a second component measured from a second source, comprising:

(a) a blending assembly operative to intimately mix materials flowing therethrough, said blending assembly including a dispensing nozzle for dispensing said composite material and a blending element;

(b) first metering means for metering a first selected quantity of said first component, said first metering means switchable between a first measuring mode wherein said first metering means is in fluid communication with the first source whereby the first selected quantity of said first component is measured and a first discharge mode wherein said first metering means is in fluid communication with said blending assembly whereby the first selected quantity may be introduced into said blending assembly;

(c) a second metering means for metering a second selected quantity of said second component, said second metering means switchable between a second measuring mode wherein said second metering means is in fluid communication with said second source whereby the second selected quantity of said second component is measured and a second discharge mode wherein said second metering means is fluid communication with said blending assembly whereby the second selected quantity may be introduced into said blending assembly;

(d) a mixing chamber disposed between said dispensing nozzle and each of said first and second metering means and defining an elongated serpentine flowpath having a plurality of flowpath portions parallel to one another and in fluid communication with said first and second metering means whereby said first and second components are concurrently introduced into said mixing chamber and then dispensed through said blending nozzle, said blending element formed by a plurality of static blending element sections disposed in respective ones of said flowpath portions;

(e) control means for cyclically operating said first and second metering means to place said first metering means in said first measuring mode and said first discharge mode and said second metering means in said second measuring mode and said second discharge mode, said control means operative to concurrently place said first and second metering means in the respective said first and second discharge mode; and (f) ejection means for concurrently ejecting the first and second selected quantities out of said first and second metering means so that said first and second selected quantities are introduced into said blending assembly and thereafter dispensed through said dispensing nozzle.

24. Mixing apparatus adapted for dispensing a selected quantity of composite material blended from a first component measured from a first source and a second component measured from a second source, comprising:

(a) a blending assembly operative to intimately mix materials flowing therethrough, said blending assembly including a dispensing nozzle for dispensing said composite material and a blending element;

(b) first metering means for metering a first selected quantity of said first component, said first metering means switchable between a first measuring mode wherein said first metering means is in fluid communication with the first source whereby the first selected quantity of said first component is measured and a first discharge mode wherein said first metering means is in fluid communication with said blending assembly whereby the first selected quantity may be introduced into said blending assembly, said first metering means including a valve assembly operative to switch said first metering means between said first measuring mode and said first discharge mode;

(c) a second metering means for metering a second selected quantity of said second component, said second metering means switchable between a second measuring mode wherein said second metering means is in fluid communication with said second source whereby the second selected quantity of said second component is measured and a second discharge mode wherein said second metering means is fluid communication with said blending assembly whereby the second selected quantity may be introduced into said blending assembly;

(d) control means for cyclically operating said first and second metering means to place said first metering means in said first measuring mode and said first discharge mode and said second metering means in said second measuring mode and said second discharge mode, said control means operative to concurrently place said first and second metering means in the respective said first and second discharge mode; and (e) ejection means for concurrently ejecting the first and second selected quantities out of said first and second metering means so that said first and second selected quantities are introduced into said blending assembly and thereafter dispensed through said dispensing nozzle.

25. Mixing apparatus according to claim 24 wherein said second metering means includes a second valve assembly operative to switch said second metering means between said second measuring mode and said second discharge mode.

* * * * *